US005144926A

United States Patent [19]

Kato

[11] Patent Number: 5,144,926

[45] Date of Patent: Sep. 8, 1992

[54] FUEL INJECTION PUMP OF DISTRIBUTION TYPE

[75] Inventor: Hiroaki Kato, Saitama, Japan

[73] Assignee: Zexel Corporation, Tokyo, Japan

[21] Appl. No.: 748,810

[22] Filed: Aug. 22, 1991

[30] Foreign Application Priority Data

Aug. 29, 1990 [JP] Japan ..... 2-225129

[51] Int. Cl.[5] ..... F02M 37/04; F02D 7/00

[52] U.S. Cl. ..... 123/380; 123/503; 123/449

[58] Field of Search ..... 123/382, 383, 449, 503, 123/380

[56] References Cited

U.S. PATENT DOCUMENTS

| | | | |
|---|---|---|---|
| 3,960,127 | 6/1976 | Vuaille | 123/380 |
| 4,308,834 | 1/1982 | Eheim | 123/503 |
| 4,384,560 | 5/1983 | Jager | 123/383 |
| 4,432,321 | 2/1984 | Matsuda et al. | 123/380 |
| 4,449,500 | 5/1984 | Kawatei et al. | 123/380 |
| 4,469,066 | 9/1984 | Yuzawa | 123/383 |
| 4,508,080 | 4/1985 | Nakamura | 123/383 |
| 4,513,715 | 4/1985 | Braun et al. | 123/383 |
| 4,562,810 | 1/1986 | Miyaki | 123/380 |
| 4,664,081 | 5/1987 | Eheim et al. | 123/383 |
| 4,819,606 | 4/1989 | Kawano | 123/380 |

FOREIGN PATENT DOCUMENTS

| | | |
|---|---|---|
| 55-37572 | 3/1980 | Japan . |
| 57-119132 | 7/1982 | Japan . |
| 1-8674 | 3/1989 | Japan . |

*Primary Examiner*—E. Rollins Cross
*Assistant Examiner*—Thomas N. Moulis
*Attorney, Agent, or Firm*—Fish & Richardson

[57] ABSTRACT

A fuel injection pump of the distribution type provided with a load timer is disclosed. This load timer includes a relief hole formed axially in a governor shaft, a first communication passage extending through a peripheral wall of the governor shaft surrounding the relief hole, and a second communication passage extending through a peripheral wall of a governor sleeve. As a load of an engine increases, the governor sleeve is retracted, and the area of communication between the first and second communication passages is decreased, so that the pressure within a pump chamber is increased. As a result, a fuel injection timing determined by a main timer is advanced. The injection pump further includes an atmospheric pressure compensation mechanism which adjusts the position of pivotal movement of a first lever in response to the decrease of the atmospheric pressure so as to move a control sleeve to decrease a fuel injection amount, and also so as to retract the governor sleeve to advance the fuel injection timing.

2 Claims, 3 Drawing Sheets

FUEL INJECTION PUMP OF DISTRIBUTION TYPE

BACKGROUND OF THE INVENTION

This invention relates generally to a fuel injection pump of the distribution type, and more particularly to an improvement in the operation of a load timer for adjusting the fuel injection timing.

Japanese Laid-Open (Kokai) Patent Application No. 119132/82 discloses a fuel injection pump of the distribution type. This fuel injection pump is provided with a housing 2 whose internal space serves as a pump chamber. A drive shaft 6 to which the rotation of an engine is transmitted extends into the housing 2. One end portion of the drive shaft 6 disposed within the pump chamber is connected to one end of a plunger 5 through a coupling so as to rotate the plunger 5 in a manner to allow an axial movement of the plunger 5. The other end of the plunger 5 cooperates with the housing to form a fuel pressurizing chamber 14. The rotational movement of the plunger 5 serves to distribute the fuel in the fuel pressurizing chamber sequentially to a plurality of injection nozzles. Cam mechanisms 7 and 8 for reciprocally moving the plunger 5 axially in response to the rotational movement of the plunger 5 are provided within the pump chamber. When the plunger 5 moves in one direction (that is, at a suction stroke), it draws the fuel into the fuel pressurizing chamber 14, and when the plunger 5 moves in the other direction (that is, at a pumping stroke), it pressurizes the fuel in the fuel pressurizing chamber 14.

A control sleeve 19 is axially slidably mounted on the outer periphery of the plunger 5. A cut-off port 31 in the plunger 5 is closed by the control sleeve 19 during the pumping stroke, and when the cut-off port 31 moves away from the control sleeve 19, the pressurized fuel in the fuel pressurizing chamber 14 escapes to the pump chamber via the cut-off port 31, thus finishing the fuel injection. The position of the control sleeve 19 determines the amount of injection of the fuel. A lever assembly is pivotally supported within the housing 2. The position of the control sleeve 19 and hence the fuel injection amount are adjusted by this lever assembly. A governor spring 41 for receiving an operating force of an accelerator pedal is accommodated within the housing 2. The governor spring 41 urges the lever assembly to be pivotally moved so as to move the control sleeve 19 in the direction of the pumping stroke of the plunger 5, that is, so as to increase the fuel injection amount. A governor is also received within the housing 2. This governor urges the lever assembly to be pivotally moved so as to move the control sleeve 19 in the direction of the suction stroke of the plunger 5, that is, so as to decrease the fuel injection amount. This governor comprises a governor shaft 45 fixedly mounted on the housing 2 and extending into the pump chamber, a governor sleeve 37 axially slidably mounted on the outer periphery of the governor shaft 45, a rotation member 46 mounted on the governor shaft 45 so as to be rotated by the rotation of the drive shaft 6, and fly weights 47 supported on the rotation member 46. Under the influence of the centrifugal force of the fly weights 47 caused by the rotation of the rotation member 46, the governor sleeve 37 urges the lever assembly to be pivotally moved.

A main timer 39 is provided on the housing 2. The main timer 39 adjusts the above cam mechanisms 7 and 8 in accordance with the pressure in the pump chamber so as to adjust the fuel injection timing. This adjustment is made in such a manner that the higher the pressure in the pump chamber is, the earlier the fuel injection timing is.

The fuel injection pump of the above prior publication is also provided with a load timer which cooperates with the main timer 39 to adjust the fuel injection timing in accordance with the load of the engine. This load timer includes the above-mentioned governor. The load timer further includes a relief hole 49 formed in the governor shaft 45 and extending axially thereof, a first communication passage passing through the peripheral wall of the governor shaft 45 surrounding the relief hole 49, and a second communication passage passing through the peripheral wall of the governor sleeve 37. The first communication passage has a single annular groove 48 formed in the outer peripheral surface of the governor shaft 45, and a port communicating the annular groove 48 with the relief hole 49. The second communication passage is defined by a single control hole 50 of a small cross-sectional area.

The above load timer is of a well-known construction. In this load timer, when the engine load is low, the governor sleeve 37 is positioned forwardly, and therefore the control hole 50 is in communication with the annular groove 48, so that the pressure in the pump chamber escapes to the relief hole 49. The area of communication between the control hole 50 and the annular groove 48 is equal to the total cross-sectional area of the annular groove 48, and therefore the pressure in the pump chamber is at the minimum level, so that the fuel injection timing determined by the main timer is the latest. As the engine load increases, the governor sleeve 37 is gradually retracted, and therefore the area of communication between the control hole 50 and the annular groove 48 is gradually decreased, so that the pressure in the pump chamber increases, and therefore the fuel injection timing becomes earlier or advanced. When the engine load further increases, so that the governor sleeve 37 is retracted, the control hole 50 is closed by the governor shaft 45, and therefore the pressure in the pump chamber is increased, so that the fuel injection timing becomes the earliest.

In the above known load timer, during the idling of the engine immediately after the start of the engine at cold places or high places, the fuel injection timing is late or delayed because of a low engine load, and therefore the engine may be stopped or may produce smoke. To deal with such difficulty, the fuel injection pump of the above prior publication is provided with a solenoid valve 51 for opening and closing the relief hole 49, and a control unit 52 for controlling the solenoid valve 51. The control unit 52 controls the solenoid valve 51 in accordance with information (e.g. the temperature of cooling water for the engine, the atmospheric pressure, the engine load, and so on) inputted thereto, so that the fuel injection timing can be advanced or made earlier even during a low-load operation of the engine and even at a low atmospheric pressure. However, because of the addition of the solenoid valve 51 and the associated control circuit, the cost involved is increased.

A fuel injection pump of the distribution type disclosed in Japanese Utility Model Publication No. 8674/89 (FIGS. 3 and 4) is provided with an atmospheric pressure compensation mechanism which decreases a fuel injection amount and advances a fuel injection timing when the atmospheric pressure is low. This atmospheric pressure compensation mechanism includes a bellows 32 which is axially expanded and contracted in accordance with the atmospheric pressure. An upper end of an adjust pin 35 is connected to the lower end portion of the bellows 32. The adjust pin 35 has a tapered surface 35*a*, and is supported on a housing so as to slide axially in a vertical direction. The adjust pin 35 moves downward as the bellows 32 expands. A sensor pin 36, extending in a direction perpendicular to the adjust pin 35, is also supported on the housing so as to slide axially. One end of the sensor pin 36 is in contact with the tapered surface 35*a* of the adjust pin 35 whereas the other end thereof is disposed within a pump chamber. A link 25 is pivotally supported on the housing, and an upper end of the link 25 is in contact with the other end of the sensor pin 36. When the engine is under a full load, a tension lever 24 of a lever assembly is abutted at its upper end against the lower end of the link 25 to limit the fuel injection amount. When the atmospheric pressure is low, the bellows 32 is axially expanded to move the adjust pin 35 downward, so that the link 25 is pivotally moved through the sensor pin 36. As a result, the tension lever 24 is kept at a small inclination angle by the lower end of the link 25, thereby decreasing the fuel injection amount in the full load condition of the engine. An auxiliary timer 40 is provided on the housing. The auxiliary timer 40 comprises a guide sleeve 41 fixedly mounted on the housing, and a valve member 43 received in the guide sleeve 41 for sliding movement therealong. The valve member 43 is coaxial with the sensor pin 36. The valve member 43 has a relief hole 43*a* extending axially thereof. One end of the relief hole 43*a* is communicated with the pump chamber, and the other end thereof is communicated with an annular groove 43*b*, formed in the outer periphery of the valve member 43, via a through hole 43*c*. A through hole 41*f* is formed in the guide sleeve 41, and the amount of relief of the fuel from the pump chamber is determined in accordance with the area of communication between the through hole 41*f* and the annular groove 43*b*. The valve member 43 is urged by a spring 44 to be contacted at its distal end with the sensor pin 36 through the upper end of the link 25. when the vehicle is at a low place where the atmospheric pressure is high, the area of communication between the through hole 41*f* and the annular groove 43 is large, and the pressure of the pump chamber is low. Therefore, the fuel injection timing is set by a main timer to a delayed timing. When the vehicle is at a high place where the atmospheric pressure is low, the bellows 32 is expanded to move the adjust pin 35 downward, so that the sensor pin 36 retracts the valve member 43 through the link 25, thereby decreasing the area of communication between the through hole 41*f* and the annular groove 43*b* to increase the pressure of the pump chamber. As a result, the fuel injection timing becomes earlier.

However, in the fuel injection pump of the distribution type disclosed in the above Japanese Utility Model Publication No. 8674/89, since the auxiliary timer 40 separate from the governor is required, the construction is complicated, and the cost is high. Further, the auxiliary timer 40 can not adjust the fuel injection timing in accordance with the load.

Japanese Laid-Open Patent Application No. 37572/80 discloses an atmospheric pressure compensation mechanism similar to that disclosed in the above Japanese Utility Model Publication No. 8674/89. This atmospheric pressure compensation mechanism adjusts the amount of pivotal movement of a collector lever 30 in accordance with the atmospheric pressure, thereby decreasing the fuel injection amount when the atmospheric pressure is low. However, this atmospheric pressure compensation mechanism is not designed to adjust the fuel injection timing in accordance with the atmospheric pressure.

SUMMARY OF THE INVENTION

It is an object of this invention to provide a fuel injection pump of the distribution type which not only can advance a fuel injection timing in a high-load condition, but also can advance the fuel injection timing even in a low-load condition and at a low atmospheric pressure, and is simple in construction and is not costly.

According to the present invention, there is provided a fuel injection pump of the distribution type comprising:

(a) a housing whose internal space serves as a pump chamber;

(b) a drive shaft extending into the housing and being rotatable in response to rotation of an engine, one end of the drive shaft being disposed within the housing;

(c) a plunger disposed coaxially with the drive shaft, the drive shaft being connected at the one end thereof via a coupling to one end of the plunger so as to rotate the plunger in a manner to allow an axial movement of the plunger, the other end of the plunger cooperating with the housing to form a fuel pressurizing chamber, and the plunger having a cut-off port which is communicated with the fuel pressurizing chamber and is open to an outer peripheral surface of the plunger;

(d) a cam mechanism operable in response to the rotation of the plunger so as to cause the plunger to perform a suction stroke for drawing fuel into the fuel pressurizing chamber and to cause the plunger to perform a pumping stroke for pressurizing the fuel in the fuel pressurizing chamber;

(e) a control sleeve mounted on the outer periphery of the plunger for sliding movement therealong, the cut-off port in the plunger being closed by the control sleeve during the pumping stroke, when the cut-off port is moved away from the control sleeve, the pressurized fuel in the fuel pressurizing chamber escaping to the pump chamber, thereby finishing a fuel injection, and the position of the control sleeve determining the amount of injection of the fuel;

(f) a lever mechanism mounted within the housing so as to adjust the position of the control sleeve, the lever mechanism comprising first lever means mounted on the housing for pivotal movement about a first pivot axis, and second lever means mounted on the first lever means for pivotal movement about a second pivot axis, and one end of the second lever means being engaged with the control sleeve;

(g) governor spring means mounted within the housing, the governor spring means urging the second lever means to pivotally move so as to move the control sleeve in a direction of the pumping stroke of the plunger;

(h) a governor urging the second lever means to pivotally move so as to move the control sleeve in a direction of the suction stroke of the plunger, the governor including a governor shaft fixedly mounted on the housing and extending into the pump chamber, a governor sleeve mounted on an outer periphery of the governor shaft for sliding movement therealong, a rotation member supported on the governor shaft and driven for rotation by the drive shaft, and fly weights supported on the rotation member, and the governor sleeve urging the second lever means to pivotally move under the influence of a centrifugal force exerted on the fly weights by the rotation of the rotation member;

(i) a main timer mounted on the housing, the main timer adjusting the cam mechanism in accordance with the pressure of the pump chamber, so that the higher the pressure of the pump chamber is, the earlier the timing of fuel injection becomes;

(j) a load timer cooperating with the main timer so as to adjust the fuel injection timing in accordance with a load of the engine, the load timer including the governor, the load timer further including a relief hole formed axially in the governor shaft, first communication passage means extending through a peripheral wall of the governor shaft surrounding the relief hole, and second communication passage means extending through a peripheral wall of the governor sleeve, the pressure within the pump chamber escaping to the relief hole via the first and second communication passage means, the condition of communication between the first and second communication passage means being changed when the governor sleeve is moved, so that the pressure of the pump chamber is changed to thereby cause the main timer to adjust the fuel injection timing, and the area of communication between the first and second communication passage means decreasing as the governor sleeve is retracted; and (k) atmospheric pressure compensation means for changing the position of pivotal movement of the first lever means in accordance with the atmospheric pressure, when the atmospheric pressure is low, the atmospheric pressure compensation means pivotally moving the first lever means in one direction so as to move the control sleeve in the direction of the suction stroke of the plunger to decrease the fuel injection amount and also so as to retract the governor sleeve to advance the fuel injection timing.

DESCRIPTION OF THE PREFERRED EMBODIMENT

Figure 1:
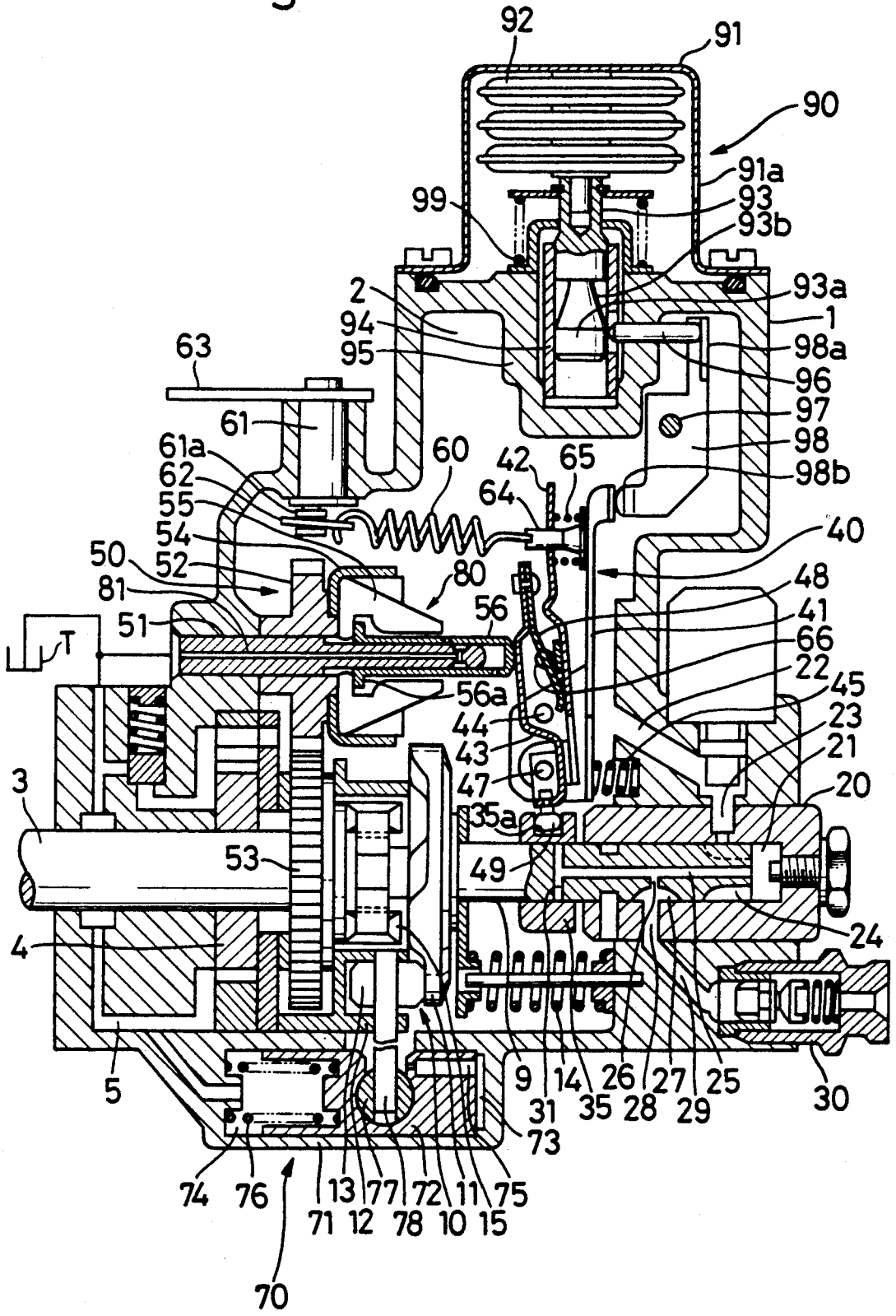
FIG. 1 is a cross-sectional view of a fuel injection pump of the distribution type.

The present invention will now be described with reference to the drawings. FIG. 1 shows an overall construction of a fuel injection pump of the distribution type. This pump comprises a housing 1, and an internal space of the housing 1 serves as a pump chamber 2. A drive shaft 3 driven for rotation by an engine extends through and is rotatably supported by a left portion (FIG. 1) of the housing 1. A feed pump 4 driven by the drive shaft 3 is accommodated within the housing 1. Fuel in a fuel tank T is drawn by the feed pump 4 into the pump chamber 2 via a low-pressure passage 5 formed in the housing 1.

A left end of a plunger 9 is connected to the right end of the drive shaft 3 extending into the pump chamber 2. More specifically, the left end of the plunger 9 is fixedly secured to a cam disk 11 of a cam mechanism 10 (later described). The drive shaft 3 is connected via a coupler 15 to the cam disk 11 so as to rotate the cam disk 11 in a manner to allow an axial reciprocal movement of the cam disk 11.

The plunger 9 is reciprocally moved by the cam mechanism 10 when the plunger 9 is rotated. The cam mechanism 10 comprises the cam disk 11, a ring-shaped roller holder 12 angularly movably supported on the housing 1, a plurality of rollers 13 (only one of which is shown in FIG. 1) rotatably supported by the roller holder 12, and a spring 14 urging the cam disk 11 against the rollers 13. When the cam disk 11 rotates relative to the rollers 13, the cam disk 11 is reciprocally moved axially, so that the plunger 9 is reciprocally moved axially in response to the reciprocal movement of the cam disk 11.

A barrel 20 extends through and is fixed to the right portion (FIG. 1) of the housing 1, and is disposed coaxially with the drive shaft 3. The barrel 20 serves as part of the housing 1. The right end portion of the plunger 9 is inserted into the barrel 20. A fuel pressurizing chamber 21 is formed by the right end of the plunger 9 and the barrel 20.

During the movement of the plunger 9 in the left direction, that is, during a suction stroke, the fuel in the pump chamber 2 is drawn to the fuel pressurizing chamber 21 via a fuel supply passage 22 formed in the housing 1, a port 23 formed in the barrel 20 and one of a plurality of inlet slits 24 formed in the outer peripheral surface of the right end portion of the plunger 9.

During the movement of the plunger 9 in the right direction, that is, during a pumping stroke, the pressurized fuel in the fuel pressurizing chamber 21 is fed to one of a plurality of delivery valves 30 mounted on the housing via an axial bore 25 in the plunger 9, a port 26 extending radially from the axial bore 25 intermediate the opposite ends of the axial bore 25, an outlet slit 27 formed in the outer peripheral surface of the plunger 9, one of a plurality of ports 28 formed radially in the barrel 20, and one of a plurality of fuel discharge passages 29 formed in the housing 1. The pressurized fuel is further fed from this delivery valve 30 via a pipe (not shown) to one of a plurality of injection nozzles mounted on the engine, and is injected there. The rotation of the plunger 9 contributes to the supply of the fuel from the fuel pressurizing chamber 21 sequentially to the plurality of injection nozzles.

The plunger 9 has a cut-off port 31 which extends radially from the left end of the axial bore 25 and is open to the outer peripheral surface of the plunger 9. A control sleeve 35 is fitted on the outer periphery of the plunger 9 so as to slidably move therealong. The control sleeve 35 closes the cut-off port 31 at the pumping stroke of the plunger 9. When the cut-off port 31 moves away from the control sleeve 35, the pressurized fuel in the fuel pressurizing chamber 21 is spilt to the pump chamber 2 via the axial bore 25 and the cut-off port 31, and the fuel injection is finished. Therefore, if the control sleeve 35 is displaced in the right direction, the stroke of movement of the plunger 9 from the start of the fuel pressurizing to the end of the fuel injection is made longer, so that the amount of the fuel injection is increased. In contrast, if the control sleeve 25 is displaced in the left direction, the fuel injection amount is decreased.

The mechanism for adjusting the fuel injection amount by adjusting the position of the control sleeve 35 will now be described. A lever assembly 40 is mounted within the housing 1. The lever assembly 40 comprises a collector lever (first lever means) 41, a tension lever 42, and a start lever 43. The tension lever 42 and the start lever 43 jointly constitute second lever means. The collector lever 41 is supported for pivotal movement about a pin (first pivot axis) 44. The collector lever 41 is urged at its lower end portion by a strong spring 45, so that its upper end portion is abutted against a link 98 of an atmospheric pressure compensation mechanism 90 (later described). The tension lever 42 and the start lever 43 are pivotally supported at their lower end portions on the lower end portion of the collector lever 41 by a pin (second pivot axis) 47. A weak start spring 48 is interposed between the upper portions of the tension lever 42 and the start lever 43 to urge them away from each other. An engagement member 49 is secured to the lower end of the start lever 43, and is received in a recess 35*a* formed in the outer peripheral surface of the control sleeve 35.

The lever assembly 40 receives angular movement moments which act in opposite directions and are applied respectively from a governor 50 and a governor spring 60 both of which are mounted within the housing 1.

The governor 50 includes a governor shaft 51 which extends into and is fixed to the housing 1, the governor shaft 50 extending parallel to the drive shaft 3. A gear 52 is rotatably mounted on the governor shaft 51, and is in mesh with a gear 53 fixedly mounted on the drive shaft 3. A governor case (rotation member) 54 is fixedly secured to the gear 52, and fly weights 55 are received within the governor case 54 and are spaced from one another at equal intervals in the direction of the circumference of the governor case 54. A governor sleeve 56 is fitted on the outer periphery of that portion of the governor shaft 51 disposed within the pump chamber 2, so as to slidably move along the governor shaft 51. The distal end of the governor sleeve 56 is always held against the start lever 43 of the lever assembly 40. A flange 56*a* is formed on the outer periphery of the proximal end portion of the governor sleeve 56, and the proximal ends of the fly weights 55 are engaged with the flange 56*a*. When the governor case 54 rotates in response to the rotation of the drive shaft 3, the fly weights 55 are opened under the influence of a centrifugal force to urge the governor sleeve 56 to advance toward the lever assembly 40, thereby applying a clockwise angular movement moment to the start lever 43.

A shaft 61 rotatably extends through the upper portion of the housing 1, and a projection 61*a* is formed on the lower end of the shaft 61 in eccentric relation to the axis of rotation of the shaft 61. One end of the governor spring 60 is connected to the projection 61*a* through an engagement member 62. A control lever 63 is attached to the upper end of the shaft 61. An engagement member 64 is attached to the other end of the governor spring 60. The engagement member 64 extends through the upper end portion of the tension lever 42, and a weak idle spring 65 is interposed between the engagement member 64 and the tension lever 42.

The control lever 63 is angularly moved in accordance with the amount of pressing-down of an accelerator pedal (not shown), so that the governor spring 60 is pulled to apply a counterclockwise angular movement moment to the tension lever 42.

At the time of the start of the engine, the tension lever 42 is pivotally moved in a counterclockwise direction under the influence of the governor spring 60, and is abutted against a stopper 66. In this condition, the start lever 43 is pivotally moved counterclockwise under the influence of the start spring 48, so that the governor sleeve 56 is in a most retracted position. Therefore, the control sleeve 35 is disposed in the most rightward position, and therefore the fuel injection amount is large.

As the engine speed increases from the time of start of the engine, the governor sleeve 56 is advanced by the centrifugal force of the fly weights 55 to pivotally move the start lever 43 clockwise against the bias of the weak start spring 48. As a result, the control sleeve 35 is moved in the left direction, and the upper end portion of the start lever 43 is abutted against the tension lever 42. Thereafter, the start lever 43 and the tension lever 42 are pivotally moved in unison, with their upper end portions held against each other.

At the time of the idling, the pivotal positions of the tension lever 42 and the start lever 43 (and hence the position of the control sleeve 35) are so determined that the counterclockwise angular movement moment applied to the tension lever 42 by the idle spring 65 is balanced with the clockwise angular movement moment applied to the start lever 43 by the advancing force of the governor sleeve 56. Since the idle spring 65 is weak, the control sleeve 35 is disposed in the most leftward position, and therefore the fuel injection amount is small.

In a normal operating condition of the engine, the pivotal positions of the tension lever 42 and the start lever 43 (and hence the position of the control sleeve 35) are so determined that the counterclowise angular movement moment applied to the tension lever 42 by the governor spring 60 is balanced with the clockwise angular movement moment applied to the start lever 43 by the advancing force of the governor sleeve 56. The more the accelerator pedal is pressed down (that is, the greater the amount of pivotal movement of the control lever 63 is to increase the pulling force of the governor spring 60), the more the control sleeve 35 is moved rightward (that is, in the direction of the pumping stroke of the plunger 9), thereby increasing the fuel injection amount. The higher the engine speed is (that is, the greater the advancing force of the governor sleeve 56 is), the more the control speed 35 is moved leftward (that is, in the direction of the suction stroke of the plunger 9), thereby decreasing the fuel injection amount.

The above operation can be discussed as follows. When the engine load is increased, the fuel injection amount is increased, and when the engine load is decreased, the fuel injection amount is decreased. The position of the governor sleeve 56 corresponds to the fuel injection amount, and therefore corresponds to the engine load.

Next, the mechanism for adjusting the fuel injection timing will now be described. As shown in FIG. 1, a main timer 70 is provided on the lower portion of the housing 1. Although the main timer 70 is actually disposed perpendicular to the sheet of FIG. 1, it is shown parallel to this sheet for better understanding of the construction. The main timer 70 comprises a cylinder portion 71 formed on the lower portion of the housing 1, and a piston 72 slidably received in the cylinder portion 71. The cylinder portion 71 has a high-pressure chamber 73 and a low-pressure chamber 74 partitioned from each other by the piston 72. The high-pressure chamber 73 is communicated with the pump chamber 2 via a passage 75 formed in the piston 72. The piston 72 is urged toward the low-pressure chamber 74 by the pressure of the high-pressure chamber 73 (that is, the pressure of the pump chamber 2). A spring 76 for urging the piston 72 toward the high-pressure chamber 73 is received in the low-pressure chamber 74. The piston 72 is positioned in such a manner that the urging force of the spring 76 is balanced with the pressure of the high-pressure chamber 73. A piece 77 is rotatably fitted in the central portion of the piston 72. The piece 77 is connected to the roller holder 12 via a rod 78.

The pressure of the high-pressure chamber 73 of the main timer 70 (that is, the pressure of the pump chamber 2) increases with the increase of the rotational speed of the feed pump 4 (that is, the engine speed). When the piston 72 moves toward the low-pressure chamber 74 in accordance with the increase of the pressure of the high-pressure chamber 73, the roller holder 12 is angularly displaced in a direction opposite to the direction of rotation of the cam disk 11. Therefore, the fuel injection timing is rendered early or advanced. In contrast, when the timer piston 72 is moved toward the high-pressure chamber 73 in accordance with the decrease of the pressure of the high-pressure chamber 73, the roller holder 12 is angularly displaced in the same direction as the direction of rotation of the cam disk 11. Therefore, the fuel injection timing is rendered late or delayed.

Figure 2A:
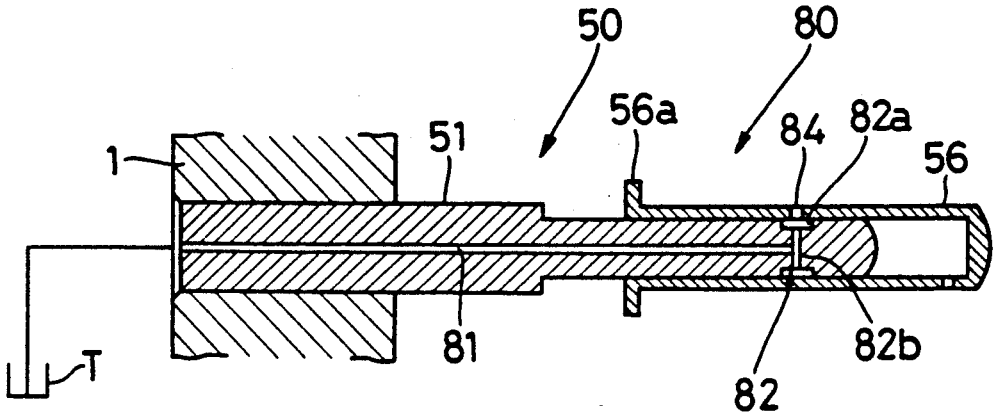
FIG. 2A is a cross-sectional views of a load timer in an idling condition of an engine when the atmospheric pressure is high.
Figure 2B:
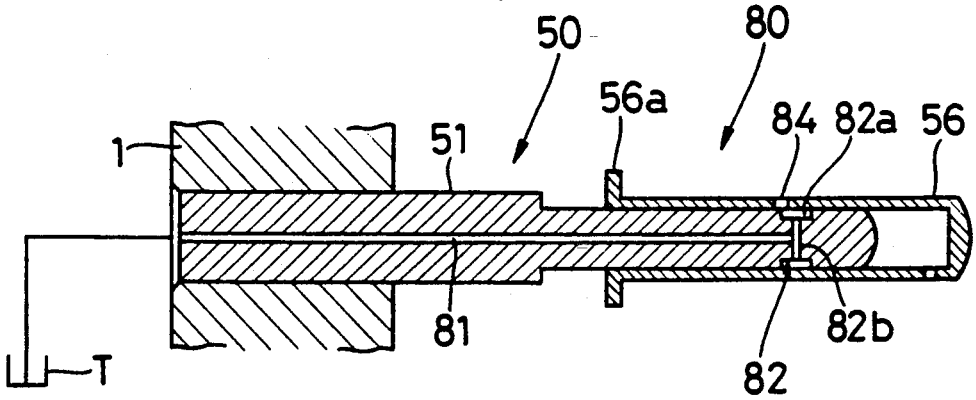
FIG. 2B is a view similar to FIG. 2A, but showing the condition when the atmospheric pressure is at an intermediate level.
Figure 2C:
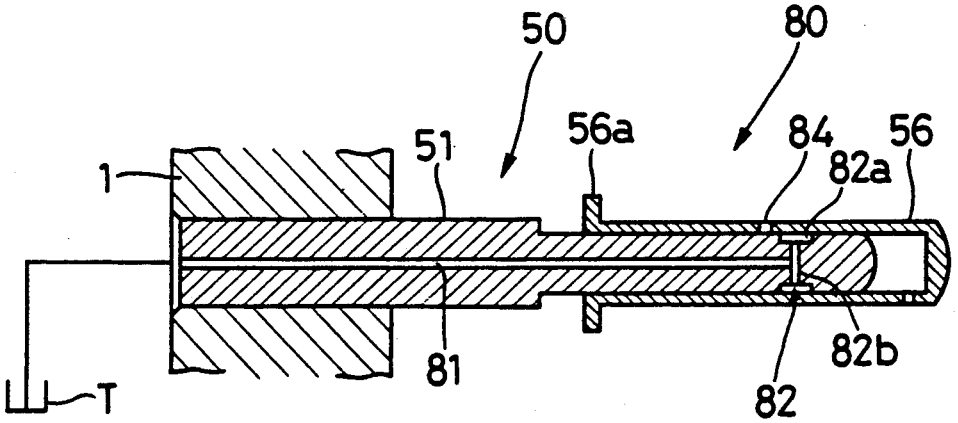
FIG. 2C is a view similar to FIG. 2A, but showing the condition when the atmospheric pressure is low.

With the provision of the main timer 70 only, the fuel injection timing can be adjusted only in accordance with the engine speed. By providing a load timer 80 cooperating with the main timer 70, the fuel injection timing can be adjusted in accordance with the engine load. The load timer 80 includes the governor 50, and as best shown in FIGS. 2A to 2C, the load timer 80 also includes a relief hole 81 formed in the governor shaft 51 and extending axially thereof, a first communication passage 82 formed through the peripheral wall of the governor shaft 51, and a second communication passage 84 formed through the peripheral wall of the governor sleeve 56. The first communication passage 82 has an annular groove 82*a* formed in the outer peripheral surface of the governor shaft 51, and a hole 82*b* extending radially to communicate the annular goove 82*a* with the relief hole 81. The second communication passage 84 is defined by a hole extending radially through the peripheral wall of the governor sleeve 56. The proximal end of the relief hole 81 is connected to the tank T.

The atmospheric pressure compensation mechanism 90, which can adjust the fuel injection amount and the fuel injection timing in accordance with the atmospheric pressure, is provided on the upper portion of the housing 1. The atmospheric pressure compensation mechanism 90 will now be described below.

A casing 91 is fixedly mounted on the upper surface of the housing 1. The casing 91 has a cylindrical peripheral wall and a flat upper wall, and a hole 91*a* for introducing the atmospheric pressure into the casing 91 is formed through this peripheral wall. A bellows 92 is received within the casing 91 in coaxial relation thereto. The bellows 92 is axially expanded when the atmospheric pressure decreases, and is axially contracted when the atmospheric pressure increases. An adjust pin 93 is fixedly secured at its upper end to the lower end of the bellows 92 in coaxial relation thereto. The adjust pin 93 is supported by a guide sleeve 94 so as to slide in its axial direction, that is, in a vertical direction. The guide sleeve 94 is fixedly received in a cylindrical guide portion 95 formed on the housing 1. The adjust pin 93 has a cylindrical surface 93*a* formed at its lower end portion, and a tapered surface 93*b* decreasing in diameter progressively from the cylindrical surface 93*a* toward the upper end of the adjust pin 93. A sensor pin 96 extends through and is supported by the guide portion 94 so as to slide in a direction perpendicular to the direction of sliding movement of the adjust pin 93. The left end (FIG. 1) of the sensor pin 96 is held in contact with either the tapered surface 93*b* or the cylindrical surface 93*a* of the adjust pin 93. The right end of the sensor pin 96 is disposed in the pump chamber 2. A link 98 is pivotally mounted by a pin 97 on the housing 1. The link 98 has at its upper end portion a first abutment portion 98*a* abutted against the right end of the sensor pin 96. The link 98 also has a second abutment portion 98*b* formed at the left side of the lower end portion thereof, the second abutment portion 98*b* being abutted against the upper end of the collector lever 41. Under the influence of the spring 45 provided at the lower end of the collector lever 41, the abutment of the upper end of the collector lever 41 against the second abutment portion 98*b* of the link 98, the abutment of the first abutment portion 98*a* of the link 98 against the right end of the sensor pin 96, and the abutment of the left end of the sensor pin 96 against the outer peripheral surface of the adjust pin 93 are maintained. The adjust pin 93 is normally urged upward by a spring 99, so that the upper end of the bellows 92 is held against the upper wall of the casing 91. The resilient force of the spring 99 is so determined as not to influence the length of the bellows 92.

The operations of the load timer 80 and the atmospheric pressure compensation mechanism 90 will now be described with reference to FIGS. 2A to 2C and FIGS. 3 and 4. First, referring briefly to the atmospheric pressure compensation for the fuel injection amount, the atmospheric pressure compensation mechanism 90 adjusts the position of pivotal movement of the collector lever 41 in accordance with the atmospheric pressure to adjust the position of the pin 47 mounted at the lower end portion of the collector lever 41. As a result, the position of the control sleeve 35 is adjusted to adjust the fuel injection amount.

The atmospheric pressure compensation for the fuel injection timing will now be described. In accordance with the adjustment of the position of the pin 47 on the collector lever 41, the position of the governor sleeve 56 is adjusted, so that the condition of communication between the annular groove 82*a* of the governor shaft 51 and the through hole 84 of the governor sleeve 56 is adjusted. As a result, the amount of relief of the fuel in the pump chamber 2 is varied to vary the pressure of the pump chamber 2. In accordance with this variation of the pressure of the pump chamber 2, the main timer 70 adjusts the roller holder 12 of the cam mechanism 10, thereby adjusting the fuel injection timing.

First, the atmospheric pressure compensation in the idling condition of the engine will be described. When the vehicle is at a low place where the atmospheric pressure is high, the bellows 92 is in its contracted condition, and the adjust pin 93 is disposed in its upper position. The left end of the sensor pin 96 is held in contact with the cylindrical surface 93*a* of the adjust pin 93, and the right end of the sensor pin 96 is disposed in a most rightward position. The pin 47 mounted on the lower end portion of the collector lever 41 is disposed in a most rightward position, and the control sleeve 35 is also disposed in a rightward position. Therefore, the fuel injection amount at this time is the largest one in the idling condition. Also, as shown in FIG. 2A, the governor sleeve 56 is advanced to a position where it is balanced with the idle spring 65, and the through hole 84 is fully opened and is communicated with the annular groove 82*a* of the governor shaft 51. Thus, the area of communication between the through hole 84 and the annular groove 82*a* is the maximum, and therefore the pressure of the pump chamber 2 at this time is the lowest one in the idling condition. As a result, the fuel injection timing set or determined by the main timer 70 is the latest one in the idling condition.

Figure 3:
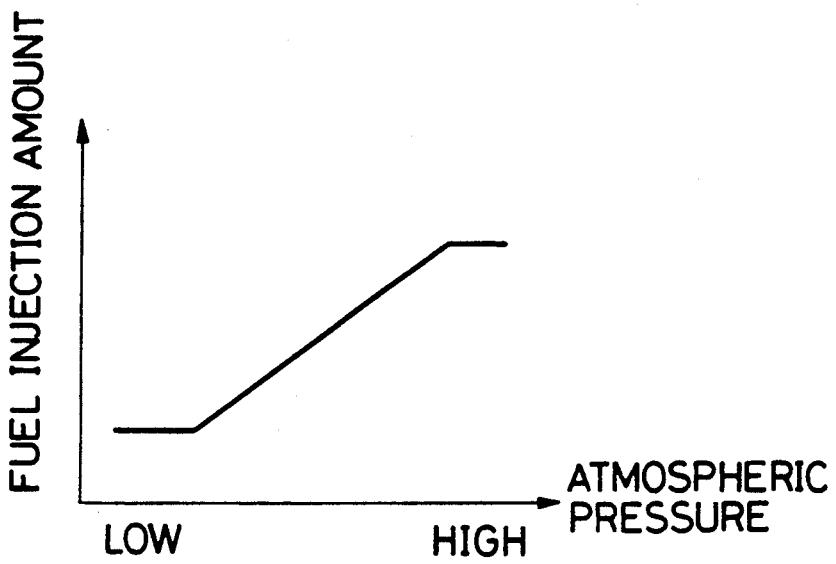
FIG. 3 is a diagrammatical illustration showing a variation of a fuel injection amount relative to the atmospheric pressure.

The lower the atmospheric pressure is, the more the bellows 92 is axially expanded, so that the adjust pin 93 moves downward. The left end of the sensor pin 96 is brought into contact with the tapered surface 93*b*, and is moved gradually in the left direction as the atmospheric pressure decreases. In response to this movement of the sensor pin 96, the link 98 pivotally moves in a counterclockwise direction, so that the second abutment portion 98*b* of the link 98 is retracted in the right direction. As a result, the collector lever 41 pivotally moves in a clockwise direction, and the pin 47 is moved in the left direction, so that the control sleeve 35 also moves in the left direction. As a result, as shown in FIG. 3, the lower the atmospheric pressure, the smaller the fuel injection amount.

Figure 4:
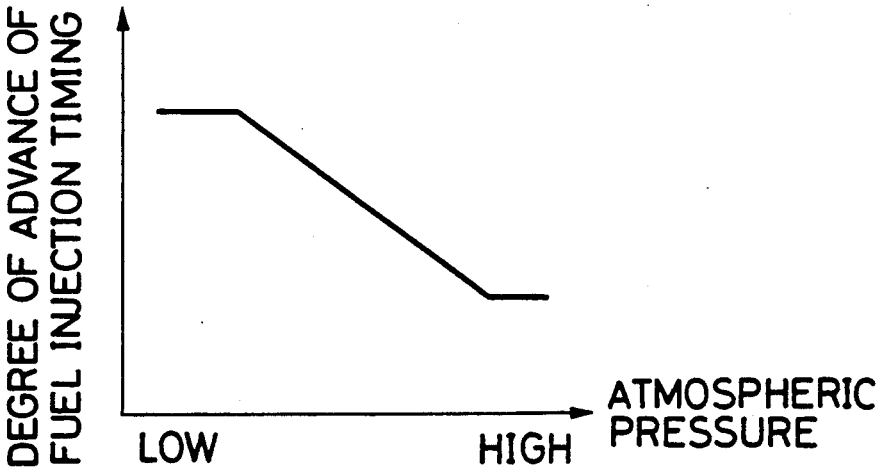
FIG. 4 is a diagrammatical illustration showing a variation of a fuel injection timing relative to the atmospheric pressure.

When the collector lever 41 pivotally moves clockwise with the decrease of the atmospheric pressure, so that the pin 47 is moved in the left direction, the governor sleeve 56 is retracted. As a result, as shown in FIG. 2B, part of the through hole 84 of the governor sleeve 56 is closed by the outer peripheral surface of the governor shaft 51, so that the area of communication between the through hole 84 and the annular groove 82*a* is decreased, thereby increasing the pressure of the pump chamber 2. Then, when the atmospheric pressure decreases below a certain level, the through hole 84 is fully closed by the outer peripheral surface of the governor shaft 51 as shown in FIG. 2C, and the communication between the through hole 84 and the annular groove 82*a* is interrupted, and the pressure of the pump chamber 2 at this time is the highest one in the idling condition. As a result, as shown in FIG. 4, the lower the atmospheric pressure, the earlier the fuel injection timing.

The above-mentioned atmospheric compensations for the fuel injection amount and the fuel injection timing are carried out also during the normal operating condition of the engine other than the idling condition.

Next, the adjustment of the fuel injection timing in accordance with the load of the engine will be described. For better understanding, the following discussion will be made assuming that the engine speed is constant. As described above, the governor sleeve 56 is moved in accordance with the load of the engine. When the engine load is low, the governor sleeve 56 is in the advanced position, and as the engine load increases, the governor sleeve 56 is retracted. As a result, the fuel injection timing can be made earlier with the increase of the load.

As described above, when the atmospheric pressure is low, the generation of smoke from the engine can be prevented by decreasing the fuel injection amount. Also, during the idling of the engine at a low atmospheric pressure, the stop of the engine can be prevented by advancing the fuel injection timing. Further, during the normal operation of the engine at a low atmospheric pressure, the generation of smoke can be prevented by advancing the fuel injection timing to make the combustion time longer. Further, even when the atmospheric pressure is high, the combustion time can be made longer by advancing the fuel injection timing, if the load is high, thereby preventing the generation of smoke.

What is claimed is:

1. A fuel injection pump of the distribution type comprising:

(a) a housing whose internal space serves as a pump chamber;

(b) a drive shaft extending into said housing and being rotatable in response to rotation of an engine, one end of said drive shaft being disposed within said housing;

(c) a plunger disposed coaxially with said drive shaft, said drive shaft being connected at the one end thereof via a coupling to one end of said plunger so as to rotate said plunger in a manner to allow an axial movement of said plunger, the other end of said plunger cooperating with said housing to form a fuel pressurizing chamber, and said plunger having a cut-off port which is communicated with said fuel pressurizing chamber and is open to an outer peripheral surface of said plunger;

(d) a cam mechanism operable in response to the rotation of said plunger so as to cause said plunger to perform a suction stroke for drawing fuel into said fuel pressurizing chamber and to cause said plunger to perform a pumping stroke for pressurizing the fuel in said fuel pressurizing chamber;

(e) a control sleeve mounted on the outer periphery of said plunger for sliding movement therealong, said cut-off port in said plunger being closed by said control sleeve during the pumping stroke, when said cut-off port is moved away from said control sleeve, the pressurized fuel in said fuel pressurizing chamber escaping to said pump chamber, thereby finishing a fuel injection, and the position of said control sleeve determining the amount of injection of the fuel;

(f) a lever mechanism mounted within said housing so as to adjust the position of said control sleeve, said lever mechanism comprising first lever means mounted on said housing for pivotal movement about a first pivot axis, and second lever means mounted on said first lever means for pivotal movement about a second pivot axis, and one end of said second lever means being engaged with said control sleeve;

(g) governor spring means mounted within said housing, said governor spring means urging said second lever means to pivotally move so as to move said control sleeve in a direction of the pumping stroke of said plunger;

(h) a governor urging said second lever means to pivotally move so as to move said control sleeve in a direction of the suction stroke of said plunger, said governor including a governor shaft fixedly mounted on said housing and extending into said pump chamber, a governor sleeve mounted on an outer periphery of said governor shaft for sliding movement therealong, a rotation member supported on said governor shaft and driven for rotation by said drive shaft, and fly weights supported on said rotation member, and said governor sleeve urging said second lever means to pivotally move under the influence of a centrifugal force exerted on said fly weights by the rotation of said rotation member;

(i) a main timer mounted on said housing, said main timer adjusting said cam mechanism in accordance with the pressure of said pump chamber, so that the higher the pressure of said pump chamber is, the earlier the timing of fuel injection becomes;

(j) a load timer cooperating with said main timer so as to adjust the fuel injection timing in accordance with a load of the engine, said load timer including said governor, said load timer further including a relief hole formed axially in said governor shaft, first communication passage means extending through a peripheral wall of said governor shaft surrounding said relief hole, and second communication passage means extending through a peripheral wall of said governor sleeve, the pressure within said pump chamber escaping to said relief hole via said first and second communication passage means, the condition of communication between said first and second communication passage means being changed when said governor sleeve is moved, so that the pressure of said pump chamber is changed to thereby cause said main timer to adjust the fuel injection timing, and the area of communication between said first and second communication passage means decreasing as said governor sleeve is retracted; and (k) atmospheric pressure compensation means for changing the position of pivotal movement of said first lever means in accordance with the atmospheric pressure, when the atmospheric pressure is low, said atmospheric pressure compensation means pivotally moving said first lever means in one direction so as to move said control sleeve in the direction of the suction stroke of said plunger to decrease the fuel injection amount and also so as to retract said governor sleeve to advance the fuel injection timing.

2. A fuel injection pump according to claim 1, in which said atmospheric pressure compensation means comprises:

(i) a spring acting on one end of said first lever means so as to apply a pivotal movement moment to said first lever means to pivotally move the same in said one direction;

(ii) a bellows expandable and contractible in accordance with the atmospheric pressure;

(iii) an adjust pin mounted on said housing for sliding movement along an axis of said adjust pin, said adjust pin being connected at one end thereof to said bellows, and said adjust pin having a cam surface on an outer peripheral surface thereof;

(iv) a sensor pin mounted on said housing for sliding movement along an axis of said sensor pin in a direction perpendicular to the axis of said adjust pin, one end of said sensor pin being held against said cam surface of said adjust pin whereas the other end of said sensor pin is disposed within said pump chamber; and (v) a link pivotally mounted on said housing, one end of said link being held against the other end of said sensor pin, the other end of said link retaining the other end of said first lever means against the bias of said spring, and when the atmospheric pressure decreases, said adjust pin being axially moved in accordance with the deformation of said bellows to thereby move said sensor pin in a direction away from said pump chamber, so that said first lever means is pivotally moved in said one direction under the influence of said spring.

* * * * *